US010480213B2

(12) United States Patent
Raz

(10) Patent No.: US 10,480,213 B2
(45) **Date of Patent: *Nov. 19, 2019**

(54) DOOR OR OTHER CLOSABLE PANEL WITH LOCK-ACTUATING LINKAGE

(71) Applicant: Dan Raz Ltd., Tirat Carmel (IL)

(72) Inventor: Amir Raz, Haifa (IL)

(73) Assignee: DAN RAZ LTD., Tirat Carmel (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/181,409

(22) Filed: Nov. 6, 2018

(65) Prior Publication Data

US 2019/0119950 A1 Apr. 25, 2019

Related U.S. Application Data

(63) Continuation of application No. 15/925,784, filed on Mar. 20, 2018, now Pat. No. 10,138,654, which is a (Continued)

(51) Int. Cl.
*E05B 65/06* (2006.01)
*E05B 17/00* (2006.01)
(Continued)

(52) U.S. Cl.
CPC ..... *E05B 17/0025* (2013.01); *E05B 63/0052* (2013.01); *E05B 65/06* (2013.01); *E05B 65/08* (2013.01); *E05C 3/124* (2013.01); *E05C 3/14* (2013.01); *E05C 19/002* (2013.01); *E05B 65/0835* (2013.01)

(58) Field of Classification Search
CPC .. E05B 17/0025; E05B 63/0052; E05B 65/06; E05B 65/08; E05B 65/0835; E05C 3/124; E05C 3/14; E05C 19/002; E05C 17/025; E05D 11/1007; E05D 15/04;
(Continued)

(56) References Cited

U.S. PATENT DOCUMENTS 313,742 A 3/1885 Kintner et al.
435,658 A 9/1890 Brennaman
(Continued)

FOREIGN PATENT DOCUMENTS

AU 627346 8/1992
AU 641561 9/1993
(Continued)

*Primary Examiner* — Chi Q Nguyen
(74) *Attorney, Agent, or Firm* — Mark M. Friedman

(57) ABSTRACT

A door or window arrangement has a panel movable relative to an opening bounded by a frame so as to close against a strike jamb or move away from it. A locking element moves between a locked state in which it engages between the panel and the strike jamb to prevent separation of the panel from the strike jamb and a released state in which the panel can be separated from the strike jamb. A linkage is displaced by a terminal part of a closing motion of the panel so that completion of the closing motion can only occur when the locking element assumes its locked state. Preferably, the linkage is deployed so that force applied to displace the panel through the terminal part of the closing motion results in a force applied to the locking element to displace it towards its locked state.

30 Claims, 13 Drawing Sheets

Related U.S. Application Data continuation of application No. 14/953,356, filed on Nov. 29, 2015, now Pat. No. 9,970,214.

(51) Int. Cl.

| | |
|---|---|
| ***E05B 63/00*** | (2006.01) |
| ***E05B 65/08*** | (2006.01) |
| ***E05C 3/12*** | (2006.01) |
| ***E05C 3/14*** | (2006.01) |
| ***E05C 19/00*** | (2006.01) |

(58) Field of Classification Search

CPC . E06B 3/36; E06B 1/52; Y10T 16/551; Y10T 16/558; Y10T 16/559

USPC ..... 49/394, 400, 398, 399, 364, 395, 501; 16/319, 374, 388, 389

See application file for complete search history.

(56) References Cited

U.S. PATENT DOCUMENTS

| | | | |
|---|---|---|---|
| 868,036 | A | 10/1907 | Tong |
| 1,231,069 | A | 6/1917 | Schaffert |
| 1,609,342 | A | 12/1926 | Winters et al. |
| 1,973,461 | A | 9/1934 | Barringer |
| 2,029,901 | A | 2/1936 | Voight |
| 2,108,965 | A | 2/1938 | Gray |
| 2,572,717 | A | 10/1951 | Gersten |
| 2,579,875 | A | 12/1951 | Stanko |
| 2,812,204 | A | 11/1957 | Squire |
| 2,834,066 | A | 5/1958 | Lybarger |
| 2,978,757 | A | 4/1961 | Ammerman |
| 3,002,592 | A | 10/1961 | Quinn |
| 3,019,493 | A | 2/1962 | Walenga |
| 3,159,093 | A | 12/1964 | Rosenfeld |
| 3,172,168 | A | 3/1965 | Suska |
| 3,222,098 | A | 12/1965 | Hausfeld |
| 3,596,954 | A | 8/1971 | Hull et al. |
| 3,634,962 | A | 1/1972 | Peterson |
| 3,841,516 | A | 10/1974 | Marz |
| 3,872,696 | A | 3/1975 | Geringer |
| 3,877,262 | A | 4/1975 | Williams |
| 3,877,282 | A | 4/1975 | Pogonowski |
| 3,924,884 | A | 12/1975 | Christie |
| 3,959,927 | A | 6/1976 | Good |
| 3,973,794 | A | 8/1976 | Green |
| 4,004,629 | A | 1/1977 | Kelly |
| 4,010,239 | A | 3/1977 | Dor |
| 4,045,065 | A | 8/1977 | Johnson |
| 4,056,276 | A | 11/1977 | Jarvis |
| 4,062,576 | A | 12/1977 | Jennings et al. |
| 4,106,239 | A | 8/1978 | Bancroft et al. |
| 4,110,867 | A | 9/1978 | Gwozdz |
| 4,126,965 | A | 11/1978 | Hoffmann |
| 4,133,142 | A | 1/1979 | Dzus, Jr. |
| 4,178,859 | A | 12/1979 | Eickhoff |
| 4,180,287 | A | 12/1979 | Young |
| 4,203,255 | A | 5/1980 | MacDonald |
| 4,216,986 | A | 8/1980 | McNinch et al. |
| 4,230,351 | A | 10/1980 | Bisbing |
| 4,300,795 | A | 11/1981 | Jennings |
| 4,367,610 | A | 1/1983 | Goode |
| 4,428,153 | A | 1/1984 | Klinger et al. |
| 4,441,277 | A | 4/1984 | Naylor |
| 4,534,587 | A | 8/1985 | Fleming |
| 4,610,472 | A | 9/1986 | Billingsley |
| 4,765,662 | A | 8/1988 | Suska |
| 4,831,779 | A | 5/1989 | Kehrli et al. |
| 4,856,830 | A | 8/1989 | Chateau |
| 5,137,327 | A | 8/1992 | Edmonds et al. |
| 5,172,520 | A | 12/1992 | Hostetler et al. |
| 5,224,297 | A | 7/1993 | Watkins |
| 5,326,141 | A | 7/1994 | Gorman |
| 5,349,782 | A | 9/1994 | Yulkowski |
| 5,403,047 | A | 4/1995 | Walls |
| 5,409,272 | A | 4/1995 | McCormack |
| 5,465,460 | A | 11/1995 | Cantone |
| 5,465,480 | A | 11/1995 | Karl et al. |
| 5,570,915 | A | 11/1996 | Asadurian |
| 5,660,021 | A | 8/1997 | Wolgamot et al. |
| 5,901,501 | A | 5/1999 | Fountaine |
| 5,927,773 | A | 7/1999 | Larsen et al. |
| 5,931,415 | A | 8/1999 | Lingard et al. |
| 6,185,871 | B1 | 2/2001 | Wang |
| 6,286,274 | B1 | 9/2001 | McKann et al. |
| 6,363,832 | B1 | 4/2002 | Francis |
| 6,409,234 | B1 | 6/2002 | Larsen et al. |
| 6,564,428 | B2 | 5/2003 | Richard et al. |
| 7,000,550 | B1 | 2/2006 | Mandall |
| 7,182,374 | B2 | 2/2007 | Figge et al. |
| 7,578,531 | B1 | 8/2009 | Leontaridis |
| 7,707,776 | B2 | 5/2010 | Weissofner et al. |
| 8,038,184 | B2 | 10/2011 | Jyrki et al. |
| 8,146,393 | B2 | 4/2012 | Katagiri et al. |
| 8,424,931 | B2 | 4/2013 | Chang |
| 8,534,000 | B1 | 9/2013 | Fadlon |
| 8,627,606 | B2 | 1/2014 | Salerno et al. |
| 8,707,625 | B2 | 4/2014 | Raz et al. |
| 8,813,427 | B2 | 8/2014 | Meeks |
| 8,925,249 | B2 | 1/2015 | Speyer et al. |
| 9,145,719 | B2 | 9/2015 | Hartford |
| 9,598,894 | B2 | 3/2017 | Raz |
| 9,670,691 | B2 | 6/2017 | Mansueto et al. |
| 9,702,168 | B2 | 7/2017 | Jadallah et al. |
| 9,970,214 | B2 * | 5/2018 | Raz ..... E05B 17/0025 |
| 9,988,830 | B2 | 6/2018 | Raz |
| 10,138,654 | B2 * | 11/2018 | Raz ..... E05B 17/0025 |
| 2002/0046501 | A1 | 4/2002 | Webb |
| 2002/0095885 | A1 | 7/2002 | Sampson |
| 2002/0145292 | A1 | 10/2002 | Furner |
| 2002/0163208 | A1 | 11/2002 | Quigley et al. |
| 2004/0222649 | A1 | 11/2004 | Ito et al. |
| 2005/0001436 | A1 | 1/2005 | Ramsauer |
| 2006/0021400 | A1 | 2/2006 | Jackson |
| 2007/0113478 | A1 | 5/2007 | Chu et al. |
| 2007/0290456 | A1 | 12/2007 | Speyer et al. |
| 2008/0129054 | A1 | 6/2008 | Tremble et al. |
| 2009/0289065 | A1 | 11/2009 | Sampson |
| 2012/0204503 | A1 | 8/2012 | Helton |
| 2013/0000205 | A1 | 1/2013 | Raz et al. |
| 2014/0190098 | A1 | 7/2014 | Raz et al. |
| 2014/0259946 | A1 | 9/2014 | Mansueto et al. |
| 2015/0123411 | A1 | 5/2015 | Woo |
| 2016/0001643 | A1 | 1/2016 | Ichikawa |
| 2016/0032627 | A1 | 2/2016 | Yoshino et al. |
| 2016/0076275 | A1 | 3/2016 | Uemura et al. |
| 2016/0076280 | A1 | 3/2016 | Rudraraju et al. |
| 2016/0083976 | A1 | 3/2016 | Rickenbaugh et al. |
| 2017/0152676 | A1 | 6/2017 | Raz |
| 2017/0254119 | A1 | 9/2017 | Raz |
| 2018/0209175 | A1 | 7/2018 | Raz |
| 2018/0252025 | A1 | 9/2018 | Raz |

FOREIGN PATENT DOCUMENTS

| | | |
|---|---|---|
| CA | 1029063 | 4/1978 |
| CN | 107923197 | 4/2018 |
| DE | 929592 | 6/1955 |
| DE | 8900012 | 3/1969 |
| DE | 2628036 | 1/1977 |
| DE | 2652562 | 6/1977 |
| DE | 2852670 | 6/1980 |
| DE | 3447796 | 7/1986 |
| DE | 8438238 | 12/1987 |
| DE | 8900012 | 3/1989 |
| DE | 29517077 | 2/1997 |
| DE | 10117173 | 10/2002 |
| DE | 10329560 | 2/2004 |
| DE | 10322798 | 12/2004 |
| DE | 102004054981 | 5/2006 |
| EP | 0067075 | 12/1982 |
| EP | 0094461 | 11/1983 |
| EP | 0270437 | 6/1988 |
| EP | 0811738 | 12/1997 |

(56) References Cited

FOREIGN PATENT DOCUMENTS

| | | |
|---|---|---|
| EP | 1422368 | 5/2004 |
| EP | 1574657 | 9/2005 |
| EP | 1775403 | 4/2007 |
| EP | 2726688 | 5/2014 |
| EP | 3341542 | 7/2018 |
| EP | 3347557 | 7/2018 |
| FR | 469276 | 7/1914 |
| FR | 2631068 | 11/1989 |
| FR | 2844822 | 3/2004 |
| FR | 2891295 | 3/2007 |
| GB | 1399058 | 6/1975 |
| GB | 2154639 | 9/1985 |
| GB | 2195958 | 4/1988 |
| GB | 2233701 | 1/1991 |
| GB | 2250772 | 6/1992 |
| GB | 2521932 | 7/2015 |
| WO | 2013001488 | 1/2013 |
| WO | 2013018496 | 3/2015 |
| WO | 2017033177 | 3/2017 |
| WO | 2017042799 | 3/2017 |
| WO | 2017090020 | 6/2017 |
| WO | 2017149544 | 9/2017 |
| WO | 2017149545 | 9/2017 |

* cited by examiner

DOOR OR OTHER CLOSABLE PANEL WITH LOCK-ACTUATING LINKAGE

FIELD AND BACKGROUND OF THE INVENTION

The present invention relates to locks for doors and other closable panels and, in particular, it concerns a door or other closable panel with a lock-actuating linkage which ensures a locking element is in its locked state whenever the panel is closed.

It is known to provide a wide range of locking arrangements for hinged or sliding doors or panels. In some cases, locking arrangements may be designed to automatically return to a locked state whenever the door is closed.

One particular family of locking mechanisms relevant to certain embodiments of the present invention is described in U.S. Pat. No. 8,707,625.

SUMMARY OF THE INVENTION

The present invention is a door or other closable panel with a lock-actuating linkage which ensures a locking element is in its locked state whenever the panel is closed.

According to the teachings of an embodiment of the present invention there is provided, an apparatus comprising: (a) an opening bounded by a frame including a strike jamb; (b) a panel mounted relative to the opening so as to be displaceable between an open position in which the panel is separated from the strike jamb to leave at least part of the opening open and a closed position in which the panel closes against the strike jamb; (c) a locking element associated with the strike jamb or the panel, the locking element being displaceable between a locked state in which the locking element engages between the panel and the strike jamb in a closed position of the panel to prevent separation of the panel from the strike jamb and a released state in which the panel can be separated from the strike jamb; and (d) a linkage associated with the locking element and deployed so as to be displaced by a terminal part of a closing motion of the panel against the strike jamb from the open position to the closed position, the linkage being deployed so that displacement of the panel through the terminal part of the closing motion applies an input force to the linkage, the linkage being configured to direct at least part of the input force to generate an output force applied to the locking element, the output force acting to displace the locking element towards the locked state.

According to a further feature of an embodiment of the present invention, the input force is applied to the linkage in a first direction, and wherein the output force is applied to the locking element in a second direction, non-parallel to the first direction.

According to a further feature of an embodiment of the present invention, the linkage is configured such that a first displacement of the panel within the terminal part of the closing motion results in a second displacement of at least part of the locking element towards the locked state, the second displacement being larger than the first displacement.

According to a further feature of an embodiment of the present invention, the linkage comprises at least one pivotally-mounted link.

According to a further feature of an embodiment of the present invention, the linkage further comprises a panel-abutment region deployed to be acted upon by the panel and a locking element actuating region deployed to act on the locking element, wherein the locking element actuating region is located further from the axis than panel-abutment region.

According to a further feature of an embodiment of the present invention, the pivotally-mounted link is mounted on a spring-loaded pivot axis.

According to a further feature of an embodiment of the present invention, displacement of the locking element between the released state and the locked state is a pivotal displacement about a locking element rotation axis.

According to a further feature of an embodiment of the present invention, the output force is applied to the locking element at a bearing surface, and wherein the locking element has a panel engaging surface for engaging the panel, a distance from the bearing surface to the rotation axis being smaller than a distance from the panel-engaging surface to the rotation axis.

According to a further feature of an embodiment of the present invention, the linkage comprises a pivotally-mounted lever arm pivotally mounted about a linkage pivot axis that is parallel to, but spaced apart from, the locking element rotation axis.

According to a further feature of an embodiment of the present invention, displacement of the locking element between the released state and the locked state is a linear displacement.

There is also provided according to the teachings of an embodiment of the present invention, an apparatus comprising: (a) an opening bounded by a frame including a strike jamb; (b) a panel mounted relative to the opening so as to be displaceable between an open position in which the panel is separated from the strike jamb to leave at least part of the opening open and a closed position in which the panel closes against the strike jamb; (c) a locking element associated with the strike jamb or the panel, the locking element being displaceable between a locked state in which the locking element engages between the panel and the strike jamb in a closed position of the panel to prevent separation of the panel front the strike jamb and a released state in which the panel can be separated from the strike jamb; and (d) a linkage having a locking-element actuating region deployed to act on the locking element and a panel-abutment region deployed so as to be displaced by a terminal part of a closing motion of the panel against the strike jamb from the open position to the closed position, the linkage being configured such that displacement of the panel through the terminal part of the closing motion displaces the panel-abutment region through a first displacement, and wherein the first displacement of the panel-abutment region results in a second displacement of the locking-element actuating region acting on the locking element, thereby displacing the locking element towards the locked state.

According to a further feature of an embodiment of the present invention, the first displacement occurs in a first direction, and wherein the second displacement occurs in a second direction, non-parallel to the first direction.

According to a further feature of an embodiment of the present invention, the second displacement is larger than the first displacement.

According to a further feature of an embodiment of the present invention, the linkage comprises at least one pivotally-mounted link pivotable about a pivot axis.

According to a further feature of an embodiment of the present invention, a distance from the locking element actuating region to the pivot axis is greater than a distance from the panel-abutment region to the pivot axis.

According to a further feature of an embodiment of the present invention, the pivotally-mounted link is mounted on a spring-loaded pivot axis.

According to a further feature of an embodiment of the present invention, displacement of the locking element between the released state and the locked state is a pivotal displacement about a rotation axis.

According to a further feature of an embodiment of the present invention, the locking-element actuating region acts on a bearing surface of the locking element, and wherein the locking element has a panel engaging surface for engaging the panel, a distance from the bearing surface to the rotation axis being smaller than a distance from the panel-engaging surface to the rotation axis.

According to a further feature of an embodiment of the present invention, the linkage comprises a pivotally-mounted lever arm pivotally mounted about a linkage pivot axis that is parallel to, but spaced apart from, the rotation axis of the locking element.

According to a further feature of an embodiment of the present invention, displacement of the locking element between the released state and the locked state is a linear displacement.

According to a further feature of an embodiment of the present invention, the locking element and the linkage are integrated with the strike jamb.

According to a further feature of an embodiment of the present invention, the locking element and the linkage are integrated with the panel.

According to a further feature of an embodiment of the present invention, the panel is hingedly mounted relative to the frame.

According to a further feature of an embodiment of the present invention, the panel is slidingly mounted relative to the frame.

There is also provided according to the teachings of an embodiment of the present invention, an apparatus comprising: (a) an opening bounded by a frame including a strike jamb; (b) panel mounted relative to the opening so as to be displaceable between an open position in which the panel is separated from the strike jamb to leave at least part of the opening open and a closed position in which the panel closes against the strike jamb; and (c) a mechanism associated with the strike jamb or the panel, the mechanism comprising a locking element displaceable between a locked state to prevent separation of the panel from the strike jamb and a released state in which the panel can be separated from the strike jamb, wherein the mechanism provides a panel abutment region deployed so as to be displaced by a terminal part of a closing motion of the panel against the strike jamb from the open position to the closed position, the mechanism being configured such that displacement of the panel abutment region by the terminal part of the closing motion of the panel results in a displacement of the locking element towards the locked state, and wherein, when displaced towards the locked state, the locking element passes a critical point of engagement between the panel and the strike jamb such that an opening force applied to the panel results in geometrical or frictional locking between the panel and the locking element opposing displacement of the locking element towards the unlocked state.

According to a further feature of an embodiment of the present invention, the mechanism is configured such that completion of the closing motion of the panel can only occur when the locking element assumes the locked state.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
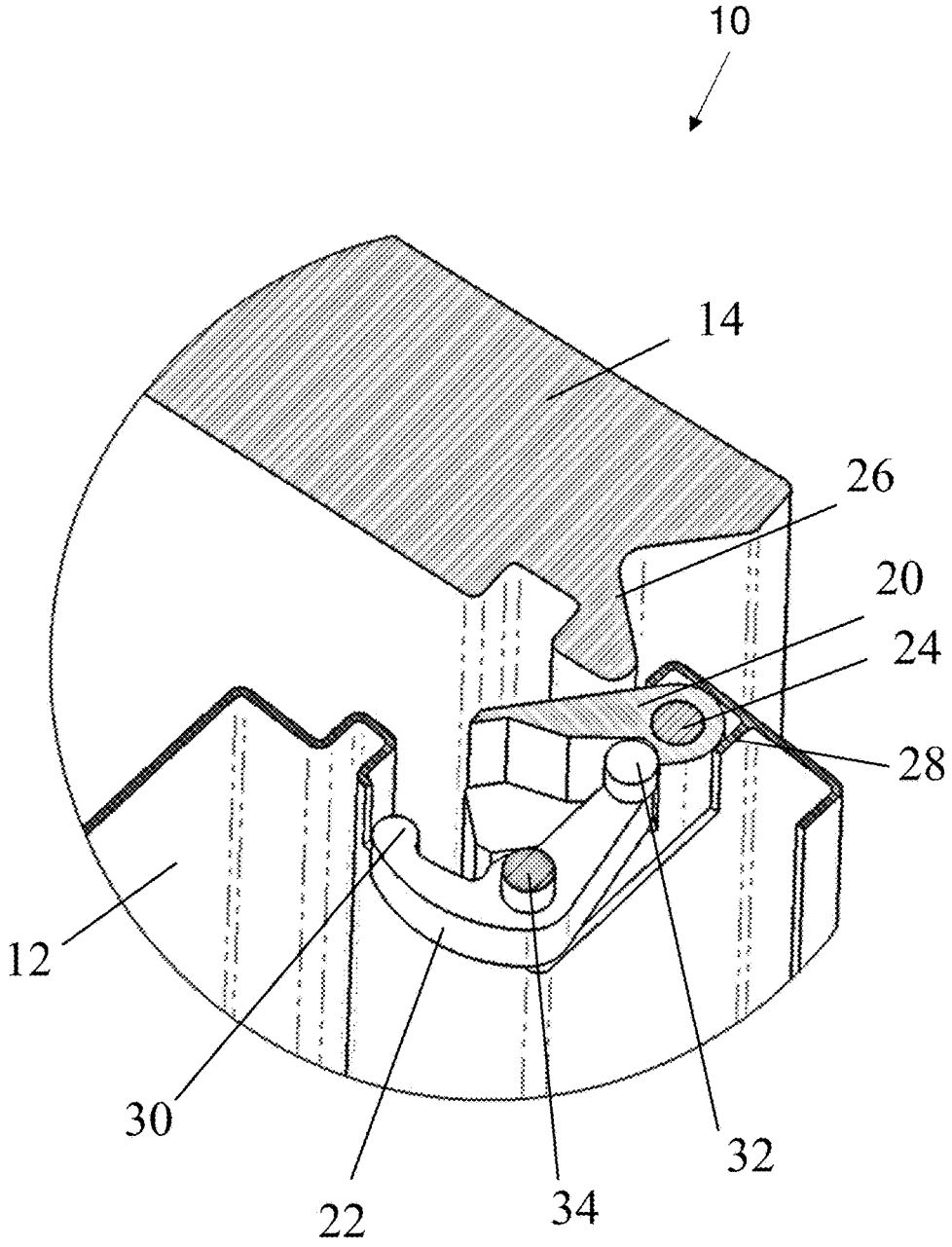
FIGS. 1A and 1B are partial, cut-away isometric views of a door and a strike jamb, constructed and operative according to the teachings of an embodiment of the present invention, showing the door prior to closing and in a fully-closed and locked state, respectively.
Figure 1B:
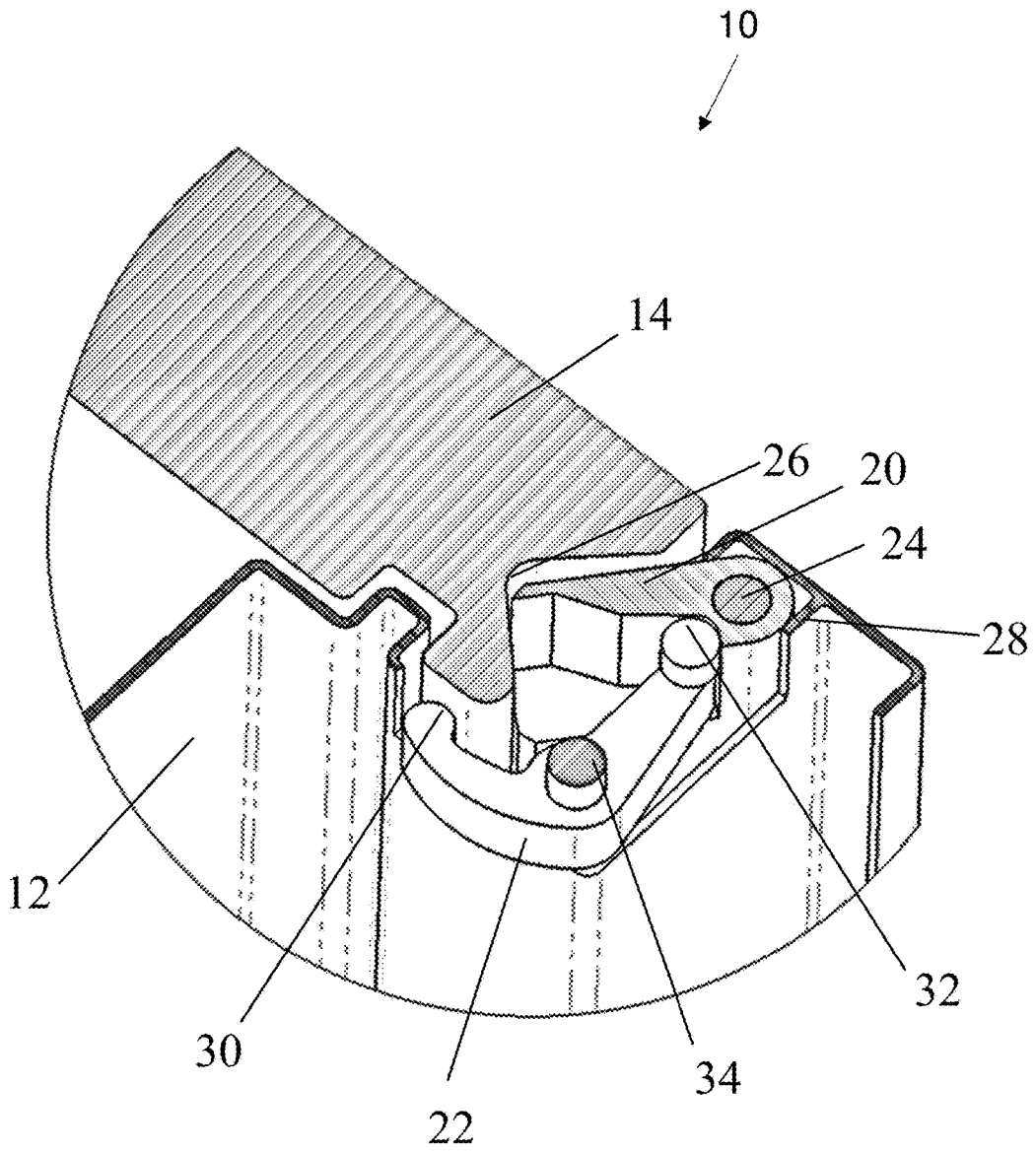
Figure 2A:
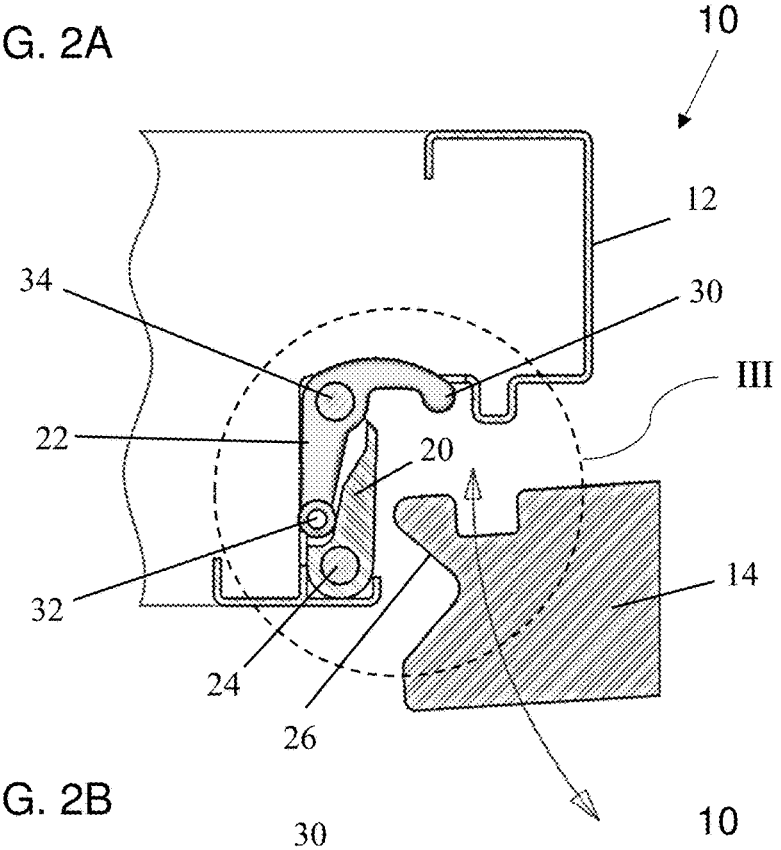
FIGS. 2A and 2B are horizontal cross-sectional views taken through the door and strike jamb of FIG. 1A shown in a partially open state and in a fully-closed and locked state, respectively.
Figure 2B:
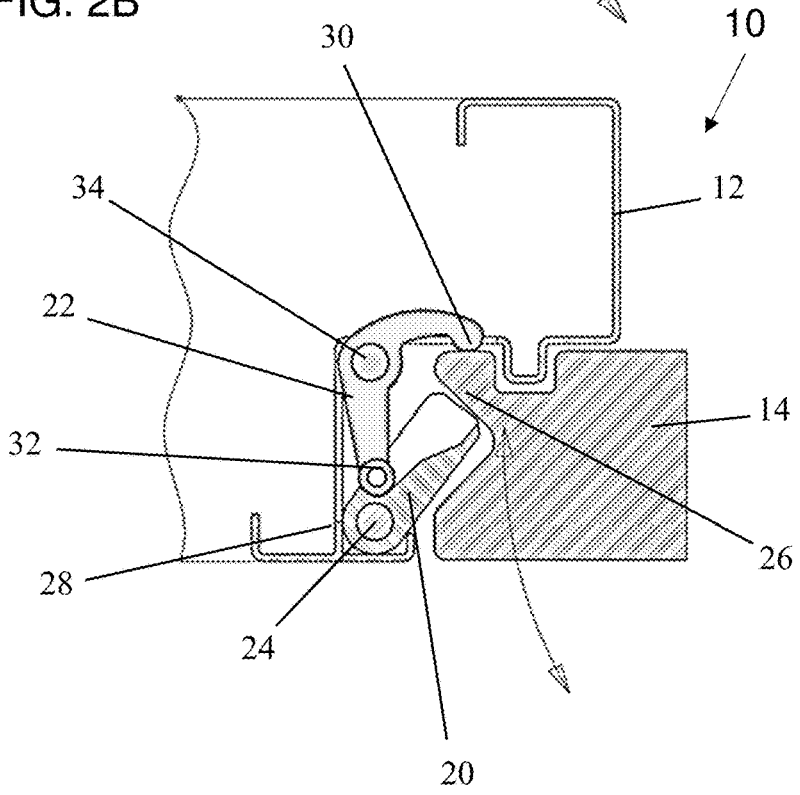

The present invention is a door or other closable panel with a lock-actuating linkage which ensures a locking element is in its locked state whenever the panel is closed.

The principles and operation of doors and other panel closures according to the present invention may be better understood with reference to the drawings and the accompanying description.

Referring first generically to all of FIGS. 1A-7D, there are shown a number of non-limiting exemplary embodiments of panel closure apparatus, generally designated 10, 100, 200 and 300, respectively. The embodiments are largely analogous to each other such that the description of various features of one embodiment are applicable also to the other embodiments, except where clearly stated or self-evident otherwise. Accordingly, for conciseness of description, reference numerals used for apparatus 10 will be used also to designate analogous elements of apparatuses 100, 200 and 300 with addition of 100, 200 and 300 to the numerals, respectively, and description of the elements in the latter embodiments can be inferred from the description of the earlier embodiments, and vice versa.

Thus, referring generically to all of the exemplary embodiments, apparatuses 10, 100, 200 and 300 relate to a panel closure for an opening bounded by a frame which includes a strike jamb 12. A panel 14 is mounted relative to the opening so as to be displaceable between an open position in which panel 14 is separated from strike jamb 12 to leave at least part of the opening open and a closed position in which panel 14 closes against strike jamb 12.

Figure 8A:
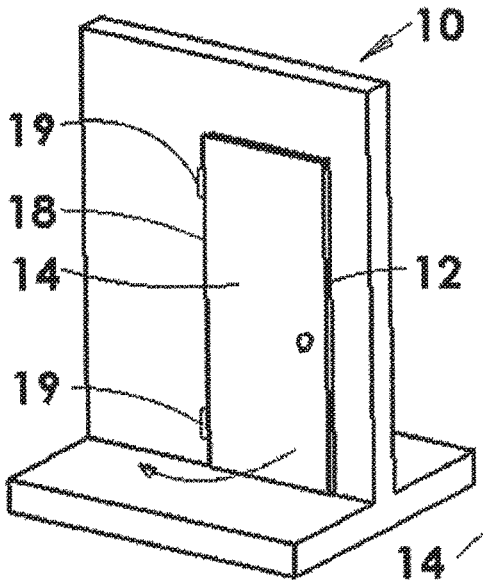
FIGS. 8A and 8B are schematic isometric overall views of a door and frame implementing the hinged-panel embodiments of the present invention described above.
Figure 8B:
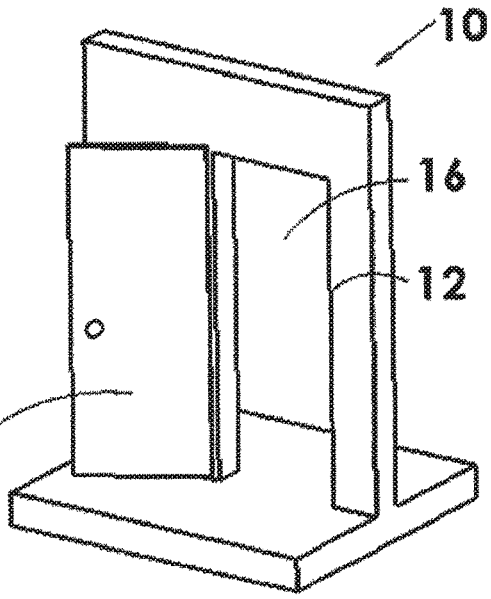
Figure 9A:
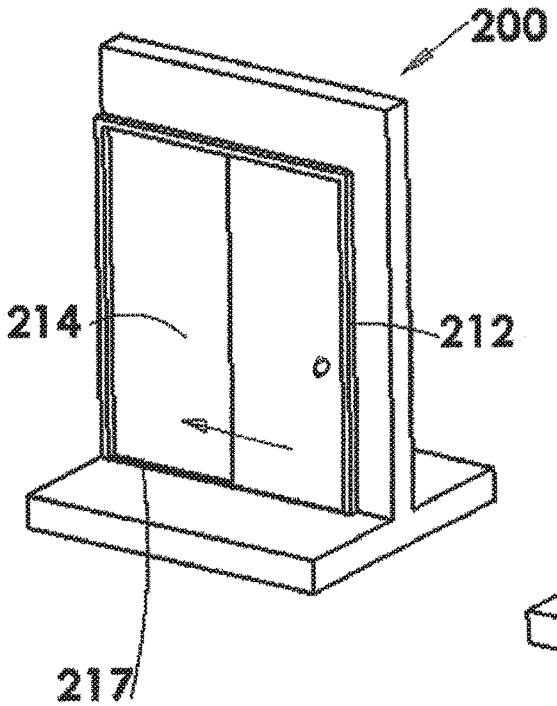
FIGS. 9A and 9B are schematic isometric overall views of a door and frame implementing the hinged-panel embodiments of the present invention described above
Figure 9B:
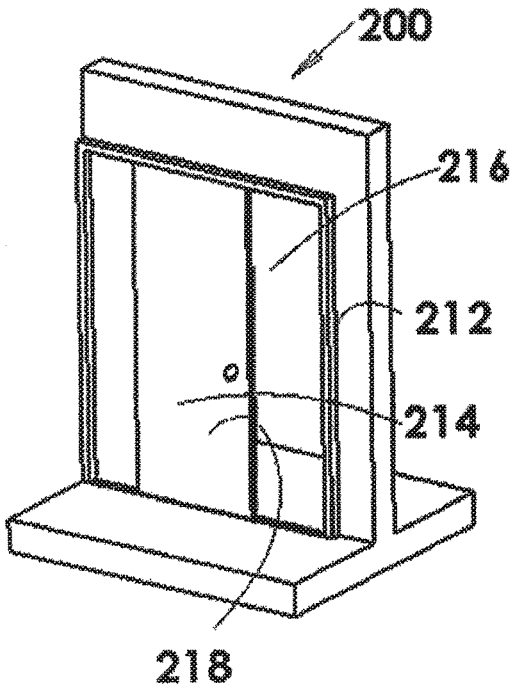

An example of an overall context of implementations of the present invention is illustrated in FIGS. 8A and 8B for hinged panels and FIGS. 9A and 9B for sliding panels (apparatus 200), showing opening 16, at least one additional frame element 18, with panel 14 shown in the closed and open positions. In the case of a hinged panel, panel 14 is typically mounted to frame element 18 via one or more hinge 19. In the case of a sliding panel, panel 214 is mounted on a track 217. In both cases, in the closed position of panel 14, the panel preferably lies roughly in a plane of closure extending across opening 16 so as to span and at least partially obstruct passage of people, objects and/or gas through opening 16, all according to the intended application.

Panel 14 is illustrated here as a door, and the terms door and panel will be used herein in the description interchangeably for convenience. It should be noted however that the present invention may be used to advantage with any type of opening and panel, including hinged and sliding windows. Furthermore, although illustrated in the context of a rectangular panel sing a rectangular opening, the invention may be applied to other standard and non-standard shapes of openings and panels. The features of embodiments of the present invention described below are best illustrated in enlarged, partial views of panel 14 and strike jamb 12, so other parts of the panel and frame have generally been omitted from the rest of the drawings.

Turning now again generically to FIGS. 1A-7D, apparatuses 10, 100, 200 and 300 further include a locking element 20 associated with either strike jamb 12 or panel 14. Locking element 20 is displaceable between a locked state (e.g., FIG. 2B) in which locking element 20 engages between panel 14 and strike jamb 12 in a closed position of the panel to prevent separation of panel 14 from strike jamb and a released state (e.g., FIG. 2A) in which panel 14 can be separated from strike jamb 12.

Also included in the apparatus is a linkage 22. Linkage 22 is deployed so as to be displaced by a terminal part of a closing motion of panel 14 against strike jamb 12 from the open position to the closed position. Linkage 22 is configured such that completion of the closing motion of panel 14 can only occur when locking element 20 assumes its locked state. Most preferably, linkage 22 is deployed such that force applied to displace panel 14 through the terminal part of the closing motion results in a force applied to locking element 20 to displace it towards its locked state.

The effect of the above structure according to various particularly preferred embodiments of the present invention is that the final part of the closing motion of the panel results in locking element 20 being reliably engaged to achieve a locked state of the panel. Conversely, if anything prevents the locking element from reaching its locked state, the panel cannot reach its fully closed position. This provides an immediate visual indication to the user of whether the door is properly locked: if the door is fully closed, it is known to be locked; if it is unlocked, it is visibly displaced from its fully closed position. This and other advantages of various preferred embodiments of the present invention will be better understood by reference to more detailed description below.

FIGS. 1A-3D illustrate a first preferred but non-limiting example of apparatus 10 for a hinged panel 14 and employing a locking element 20 which is integrated with strike jamb 12. The particularly preferred but non-limiting exemplary locking mechanism is here chosen to be similar to that described in U.S. Pat. No. 8,707,625 employing a locking element 20 which is pivotally mounted about an axis 24 which extends parallel to the extensional direction of strike jamb 12. In the locked state of FIGS. 1B, 2B and 3D, locking element 20 is wedged between an abutment surface 26 of panel 14 and the hinge pin defining axis 24, preferably with additional abutment surfaces 28 of strike jamb 12 deployed to provide support in case of extreme loads. Locking element 20 may extend along more than 10% of the long dimension (e.g., height) of strike jamb 12, and in some cases extends along a majority of the strike jamb height. Further details, options and variants of such locking mechanisms may be understood by referring to the above-referenced patent.

Linkage 22 here has panel-abutment region 30 against which the panel presses during the terminal portion of its closing motion and a locking element actuating region 32 which interacts with locking element 20. Regions 30 and 32 may be implemented as solid surfaces which abut directly against surfaces of panel 14 and locking element 20, respectively. Alternatively, one or both of these regions may be implemented with a friction-reducing contact configuration, such as bearing-mounted rollers 130 and 132 illustrated in FIGS. 4A-4D.

Linkage 22 may be a multi-link linkage employing various arrangements of rigid links (rods or the like) and pivots to achieve a desired conversion between (i.e., linking of) motion of the panel and motion of the locking element. However, in a preferred subset of implementations illustrated herein, it has been found particularly reliable and effective to employ a single, angled lever arm pivoted about an axis 34. (Lever arms with friction-reducing contact configurations such as the aforementioned rollers 130 and 132 that do not significantly alter the geometry of the interaction between linkage 22 and the abutting elements are also referred to herein as a single, angled lever arm.) The geometry of the angled lever arm is preferably chosen such that abutment regions 30 and 32 are positioned relative to axis 34 to redirect a force applied to panel 14 urging it towards its fully closed position into a force applied to locking element 20 displacing it towards its locked state. In the preferred but non-limiting examples illustrated here, linkage 22 is a roughly L-shaped lever arm, but it will be appreciated that the function of linkage 22 is determined primarily by the relative locations of abutment regions 30 and 32 and axis 34 such that the shape of the arm can be varied considerably without changing its function.

Most preferably, linkage 22 is configured to achieve some degree of mechanical motion amplification, meaning that a first displacement of the region of panel 14 contacting panel-abutment region 30 during the terminal part of the closing motion of the panel results in a second, larger displacement of at least part of locking element 20 towards its locked state. In certain implementations, this mechanical motion amplification is achieved wholly or in part by configuring linkage 22 so that locking element actuating region 32 undergoes a larger motion than panel-abutment region 30. In the single lever arm implementation, this is achieved by ensuring that locking element actuating region 32 is located further from axis 34 than panel-abutment region 30.

Figure 3A:
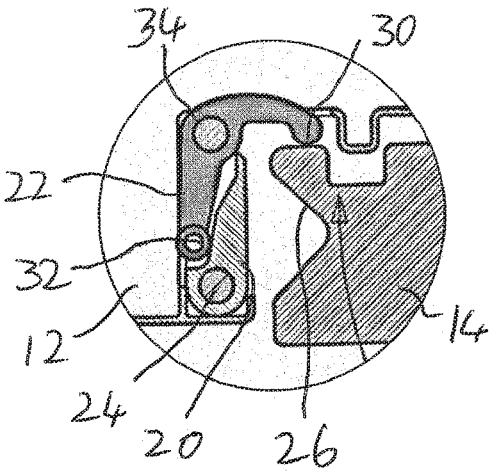
FIGS. 3A-3D are enlarged views of the region of FIG. 2A designated III, shown at four successive positions during a terminal part of a closing motion of the door.
Figure 3B:
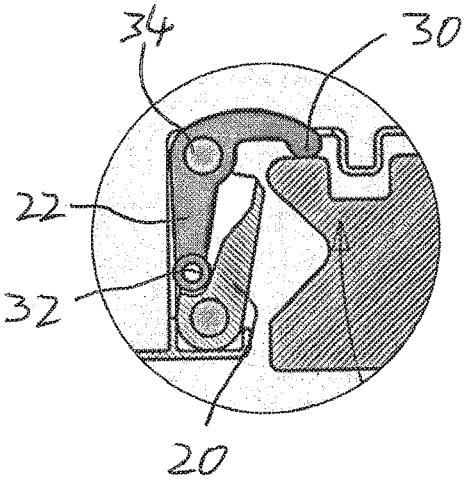
Figure 3C:
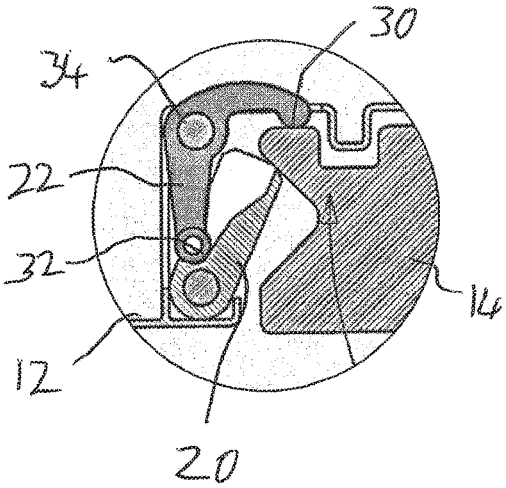
Figure 3D:
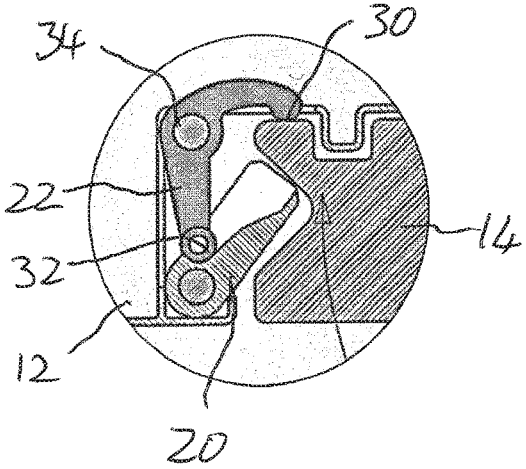

Additionally, or alternatively, the aforementioned motion amplification may be generated by the geometry of the interaction between locking element actuating region 32 and locking element 20. An example of such a geometry seen in the sequence of FIGS. 3A-3D which shows terminal stages of the closing motion of panel 14 and the corresponding motion of linkage 22 and locking element 20 caused by motion of the panel. FIG. 3A illustrates the stage of closing of panel 14 where the panel first contacts panel-abutment region 30. This is typically when the corresponding abutment surface of panel 14 is within a few centimeters from its fully closed position against strike jamb 12, and most preferably in the range of 5-20 millimeters from its final position. Continued closing motion as illustrated in FIGS. 3B-3D presses against panel-abutment region 30 to cause rotation of linkage 22 about axis 34 and hence displacement of locking element actuating region 32 that is in contact with a corresponding bearing surface of locking element 20. Since a distance from the bearing surface of locking element 20 to rotation axis 24 is smaller than a distance from the outer edge of locking element 20 to axis 24, the outer edge undergoes a relatively larger motion than the bearing surface, thereby achieving motion amplification relative to the "input" motion of panel-abutment surface 30.

In order to ensure reliable locking when panel 14 is closed to the end of its motion, linkage 22 and locking element 20 are preferably configured to bring locking element to a critical point at which effective locking occurs prior to linkage 22 reaching the end of its motion. The "critical point" is defined here as a position of locking element 20 at which a force applied to reopen the panel will be effectively opposed by the locking effect of locking element 20. The locking effect achieved when locking element reaches or passes the critical point may occur through geometrical locking, where an opening force applied to the panel does not generate any component of force on locking element 20 towards its unlocked state. Alternatively, it may rely upon frictional locking, where the angle between a plane of surface contact between locking element 20 and the cooperating surfaces) of panel 14 (or in panel-mounted embodiments, between locking element 20 and the cooperating surfaces of strike jamb 12) is inclined to the direction of force applied by an opening motion of the panel by less than the angle of friction between the surfaces. In certain cases, the geometry of the surfaces cooperating with locking element 20 is implemented such that the critical point of locking occurs as soon as there is overlap between the surfaces.

In order to allow opening of the door or panel when desired, an opening mechanism (not shown) is typically associated with locking element 20 so as to allow selective displacement of locking element 20 away from its locked position towards its unlocked position. The opening mechanism may be any one or combination of a mechanical handle, a key operated mechanism, or an electronic actuation system. In one particularly simple implementation illustrated in FIG. 5, the opening mechanism may simply be a handle 236 integrated with and projecting from locking element 20 so as to allow manual pivoting of locking element 20 about axis 224. Due to the presence of linkage 22, displacement of locking element 20 out of locking engagement is typically accompanied by ejection of the panel from its fully closed position to a noticeably displaced position.

In the case of the pivotally-mounted locking elements of apparatuses 10, 100 and 200, locking element 20 is preferably formed with an inclined external surface such that the locking element is pushed aside during closing motion of panel 14. As a result, it is not typically critical whether the resting state of the assembly is with locking element 20 in the locked position (e.g., as in FIG. 1A) or in an unlocked position (e.g., as in FIG. 2A). If the locking element 20 is initially in the locked position of FIG. 1A, contact of the leading faces of panel 14 first contact locking element 20 during the closing motion, forcing the locking element 20 to pivotally retract towards its unlocked position sufficiently to allow the leading part of panel 14 to pass locking element 20. In either case, the subsequent motion of panel 14 brings it in contact with linkage 22 resulting in the locking motion sequence of FIGS. 3B-3D. In certain implementations, a spring (not shown) may be included in the assembly to bias locking element 20 to a desired position, for example, the locked position.

Figure 4A:
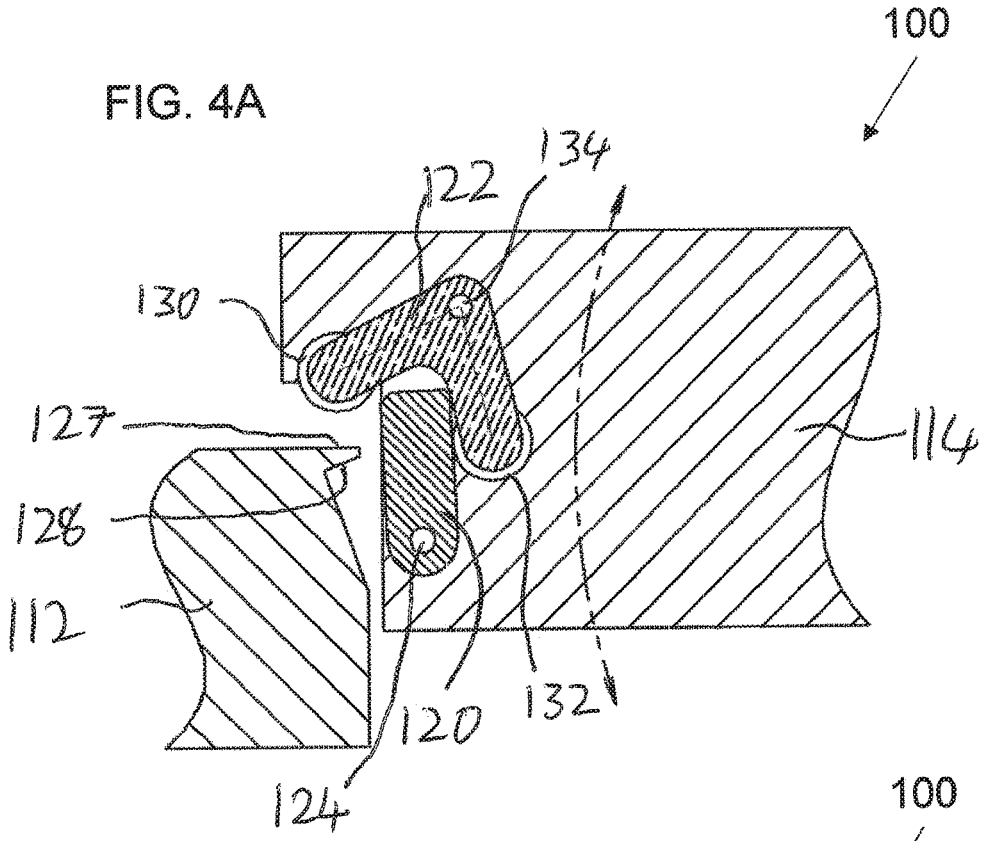
FIGS. 4A-4D are horizontal cross-sectional views taken through an alternative implementations of a door and strike jamb according to an embodiment of the present invention employing a panel-based locking arrangement, shown at four successive positions during a terminal part of a closing motion of the door.
Figure 4B:
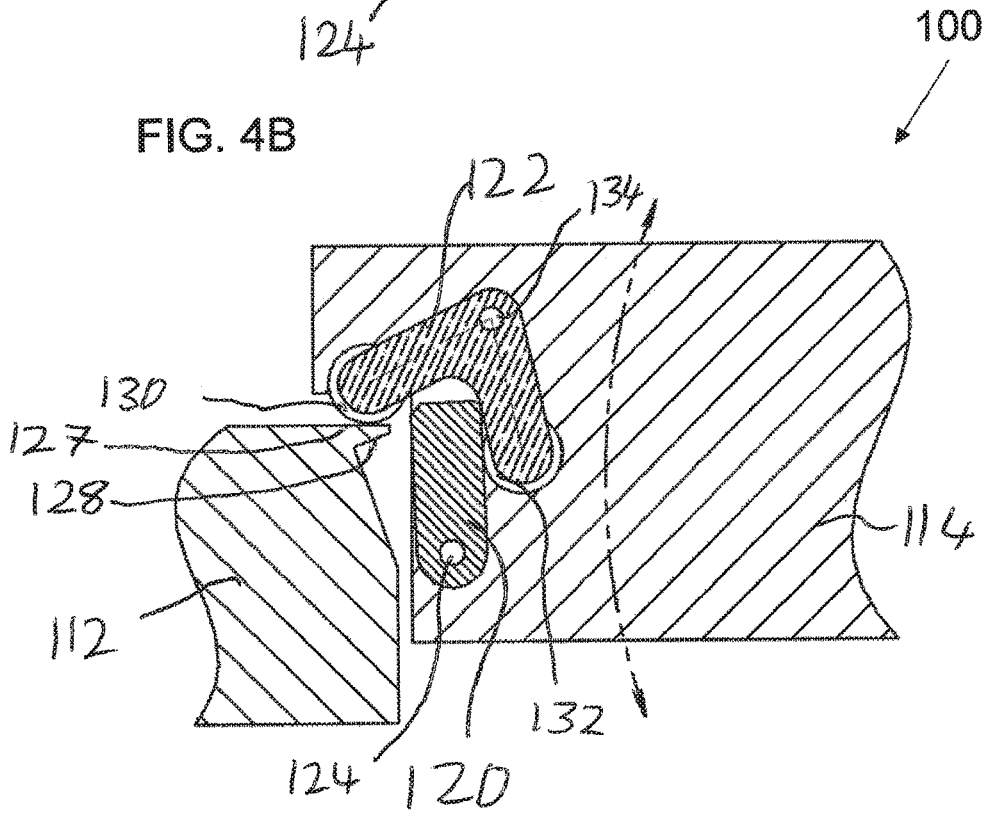
Figure 4C:
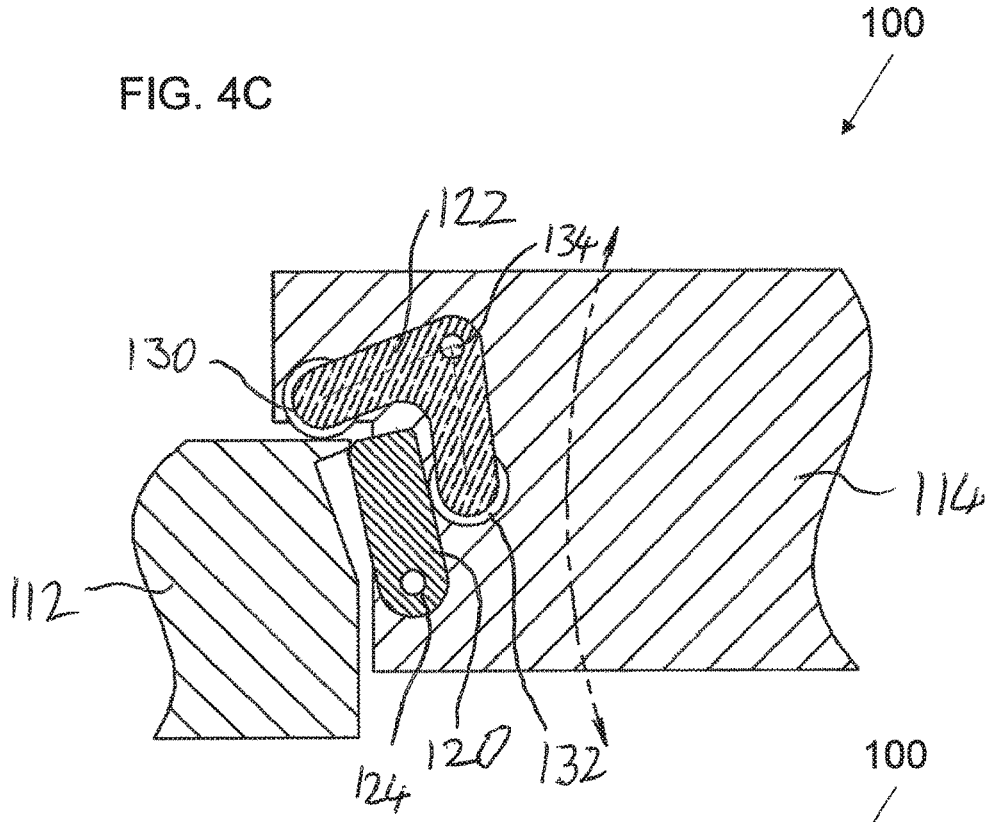
Figure 4D:
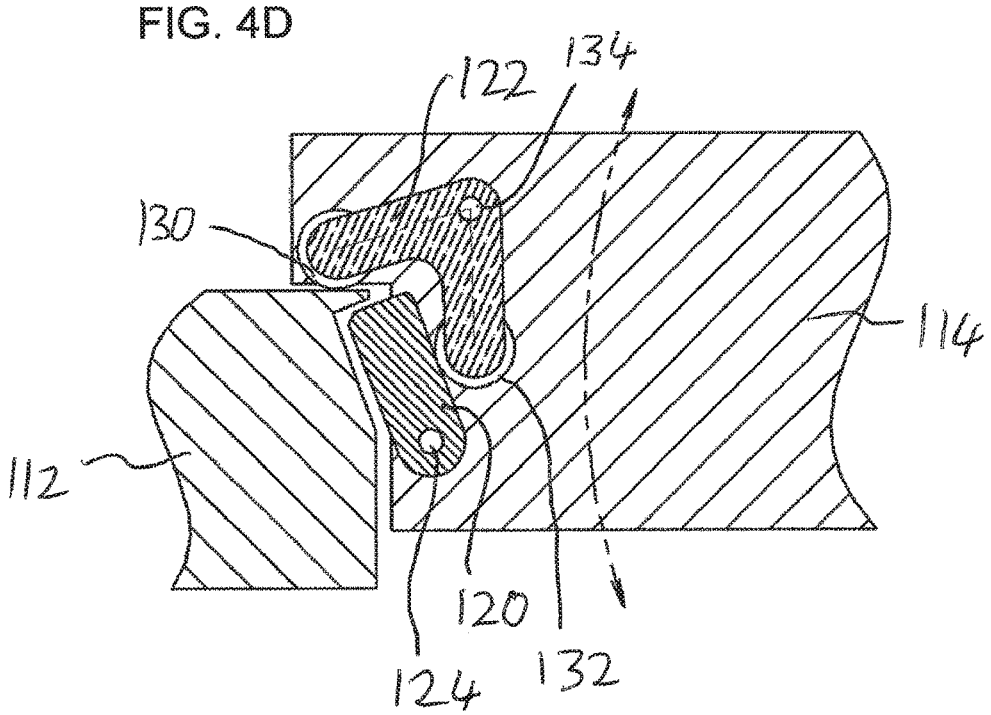
Figure 5:
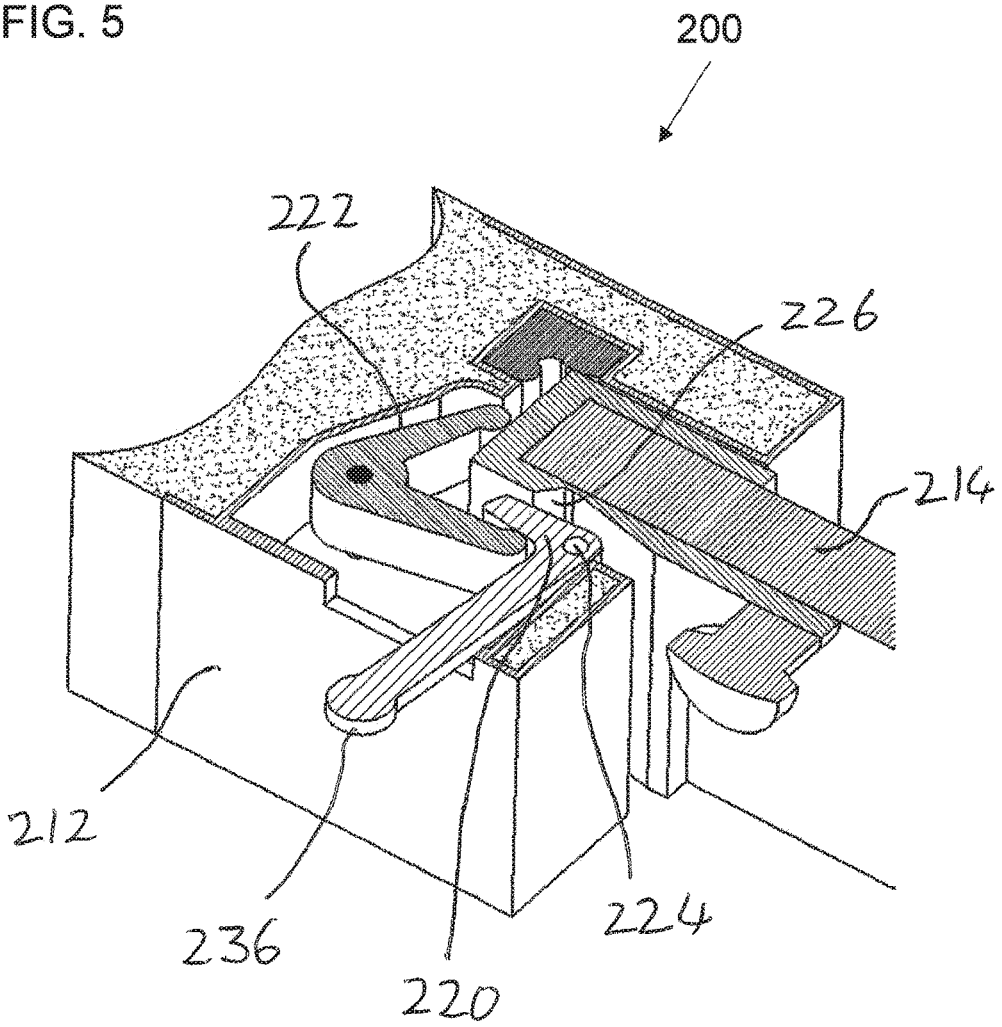
FIG. 5 is a partial, cut-away isometric view of a door and a strike jamb, constructed and operative according to the teachings of a further embodiment of the present invention, suitable for sliding panels.

Turning now briefly to apparatus 100 (FIGS. 4A-4D), in contrast with apparatus 10 in which locking element 20 and linkage 22 are integrated with strike jamb 12, apparatus 100 shows an example in which locking element 120 and linkage 122 are integrated with panel 114. In this case, an abutment surface 127 of strike jamb 112 provides the actuating contact for abutment region 130 of linkage 122, and an inward facing abutment surface 128 of strike jamb 112 provides the locking surface against which locking element 120 engages in the locked state (FIG. 4D). Other than the mounting of the mechanism within the panel, the structure and function of apparatus 100 is fully analogous to that of apparatus 10 above. As mentioned earlier, the above description is to be considered a direct description of apparatus 100, with 100 added to the reference numerals, except where it is explicit or self-evident that the description applies exclusively to other embodiments.

Figure 6A:
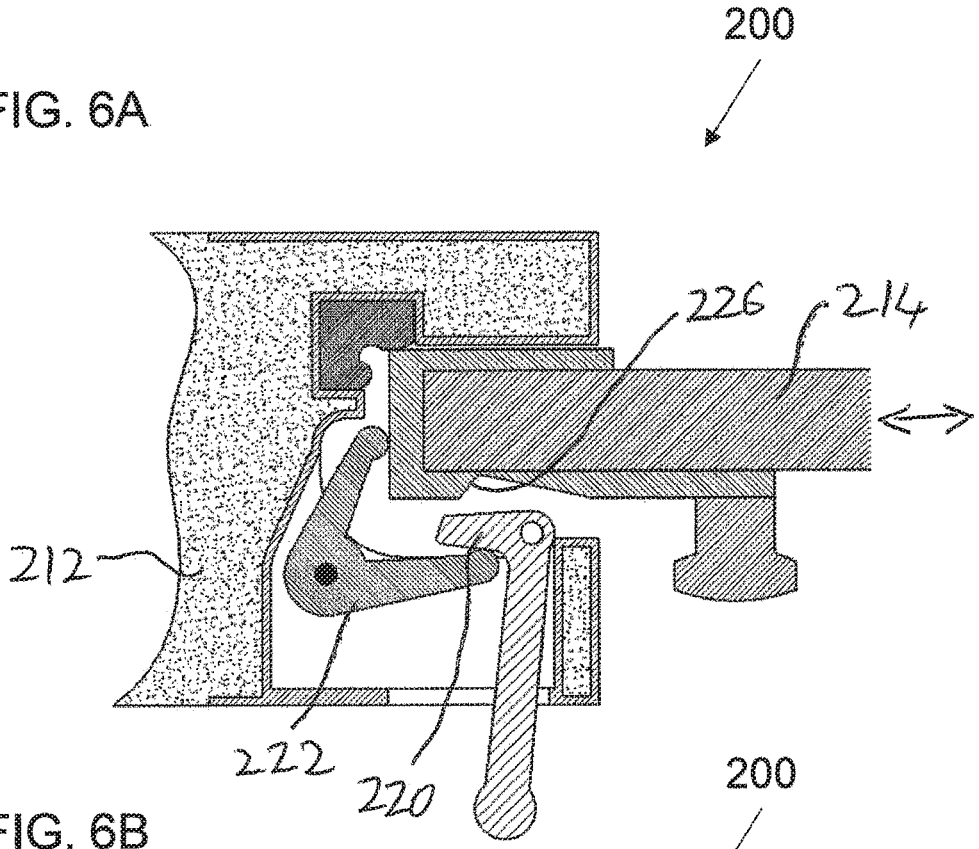
FIGS. 6A-6C are horizontal cross-sectional views taken through the door and strike jamb of FIG. 5 showing the door in a released state, a transition state and a locked state, respectively.
Figure 6B:
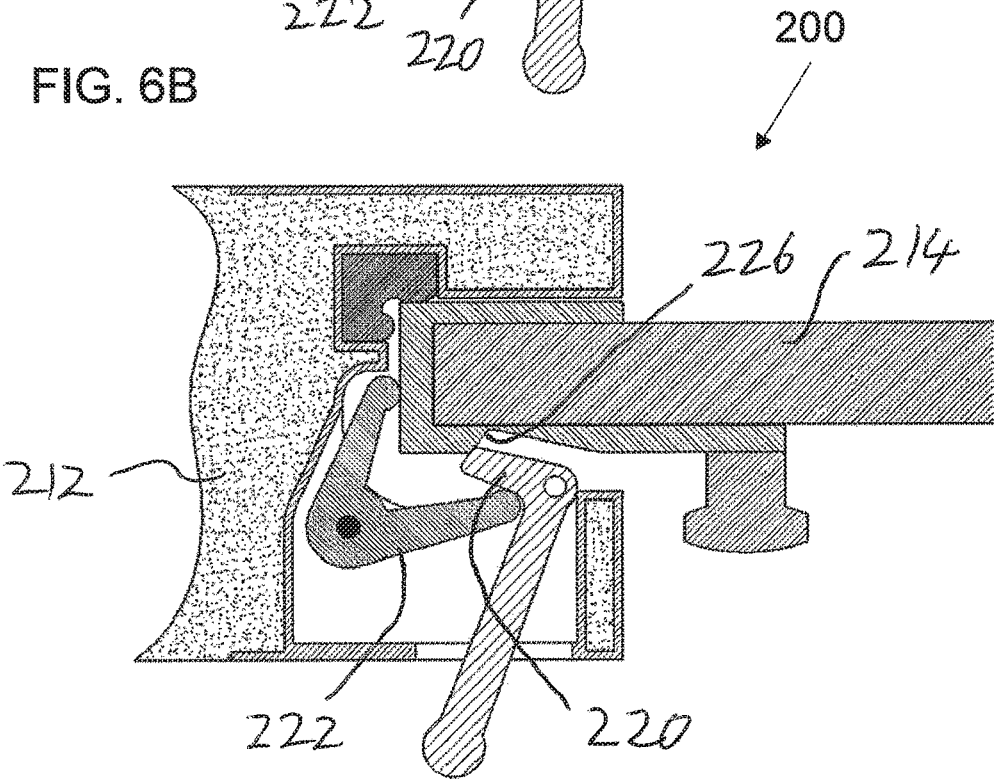
Figure 6C:
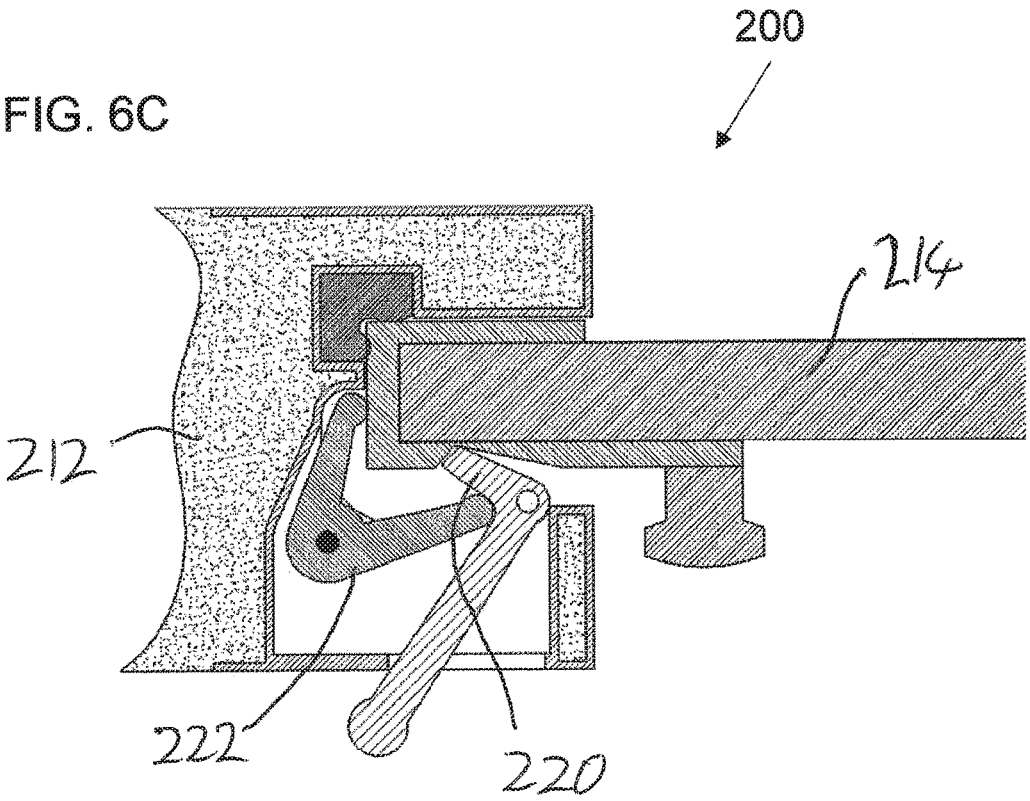
Figure 6D:
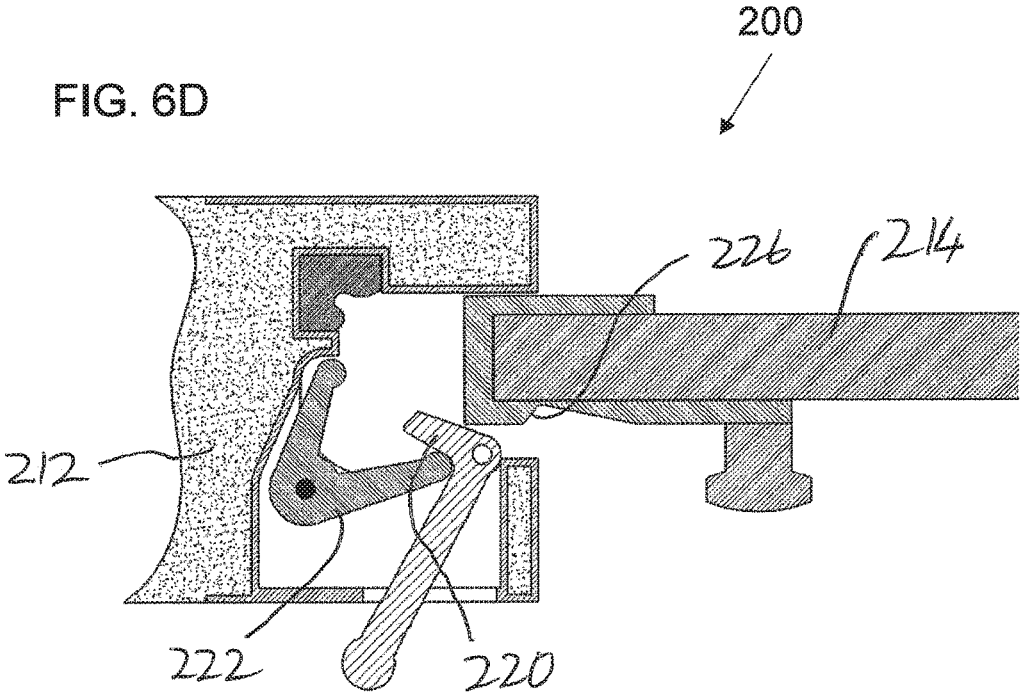
FIGS. 6D and 6E are views similar to FIG. 6A showing the door at two successive stages of closing.
Figure 6E:
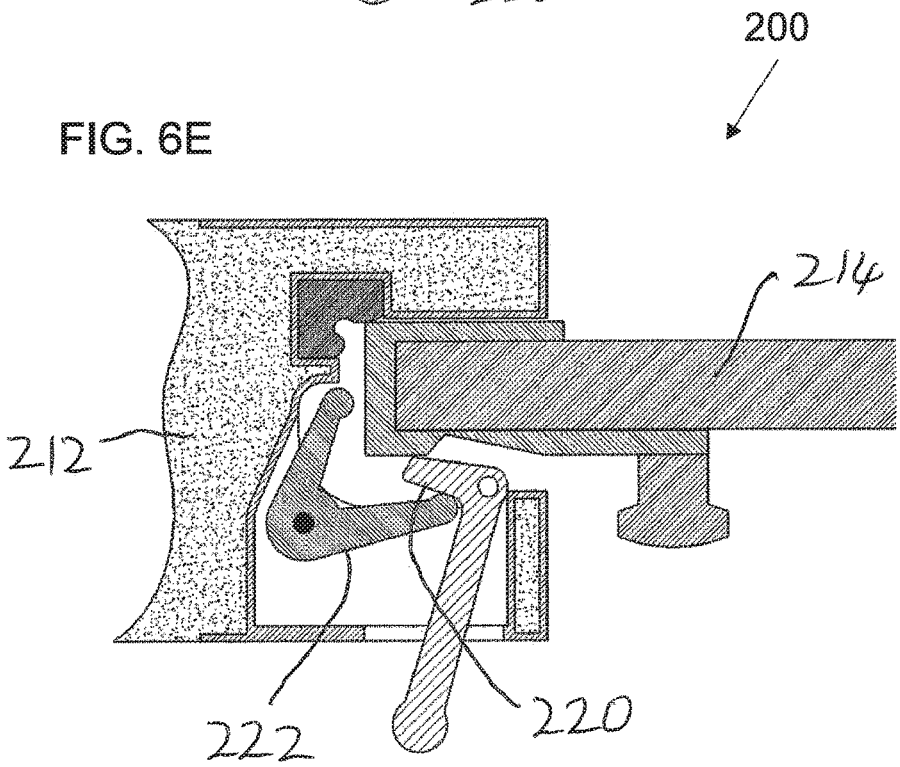
Figure 7A:
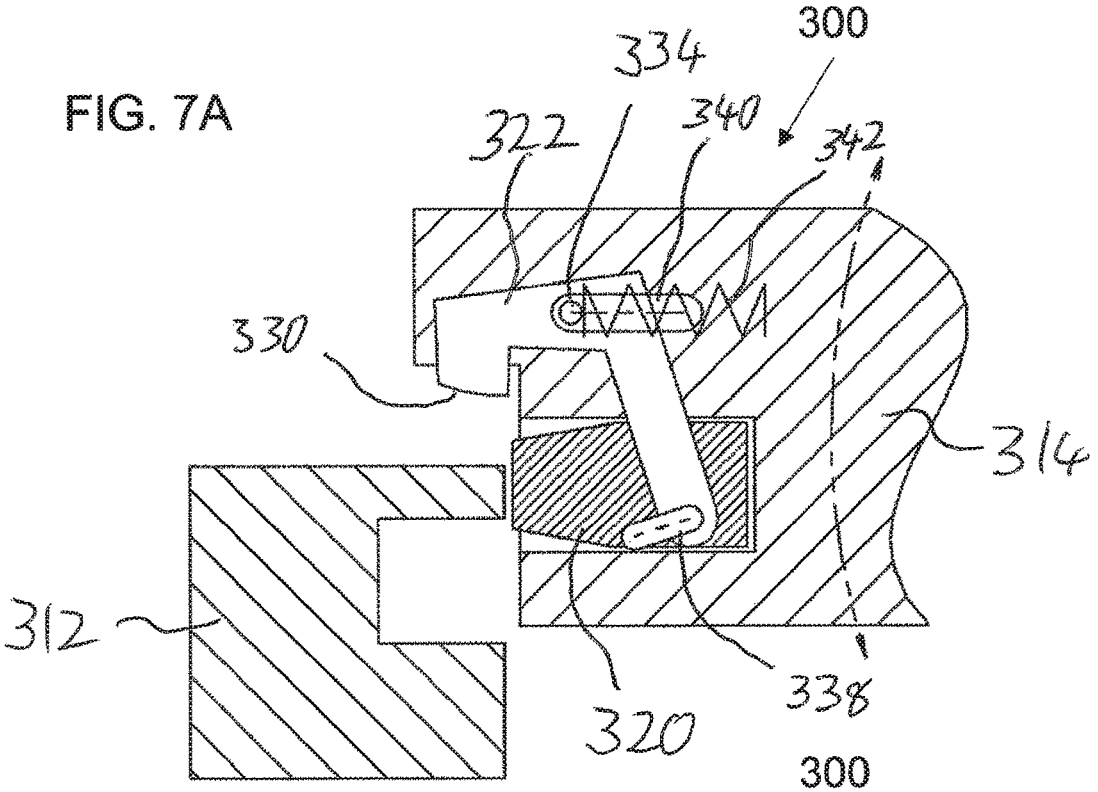
FIGS. 7A-7D are horizontal cross-sectional views of a door and a strike jamb, constructed and operative according to the teachings of a further embodiment of the present invention, the door being shown at four successive stages of closing.
Figure 7B:
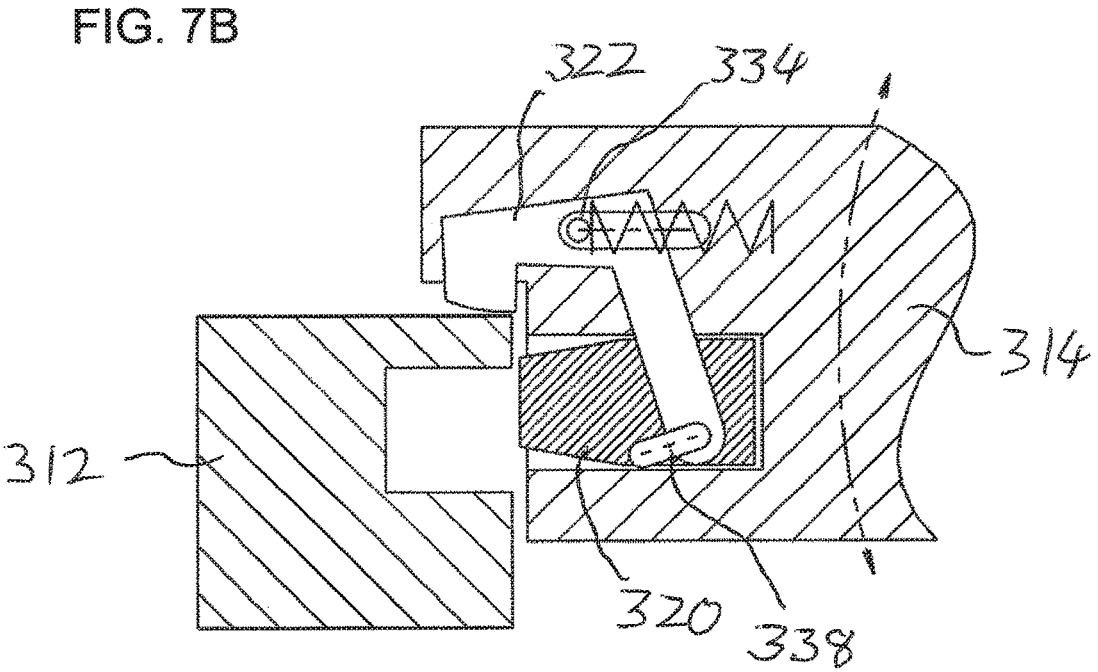
Figure 7C:
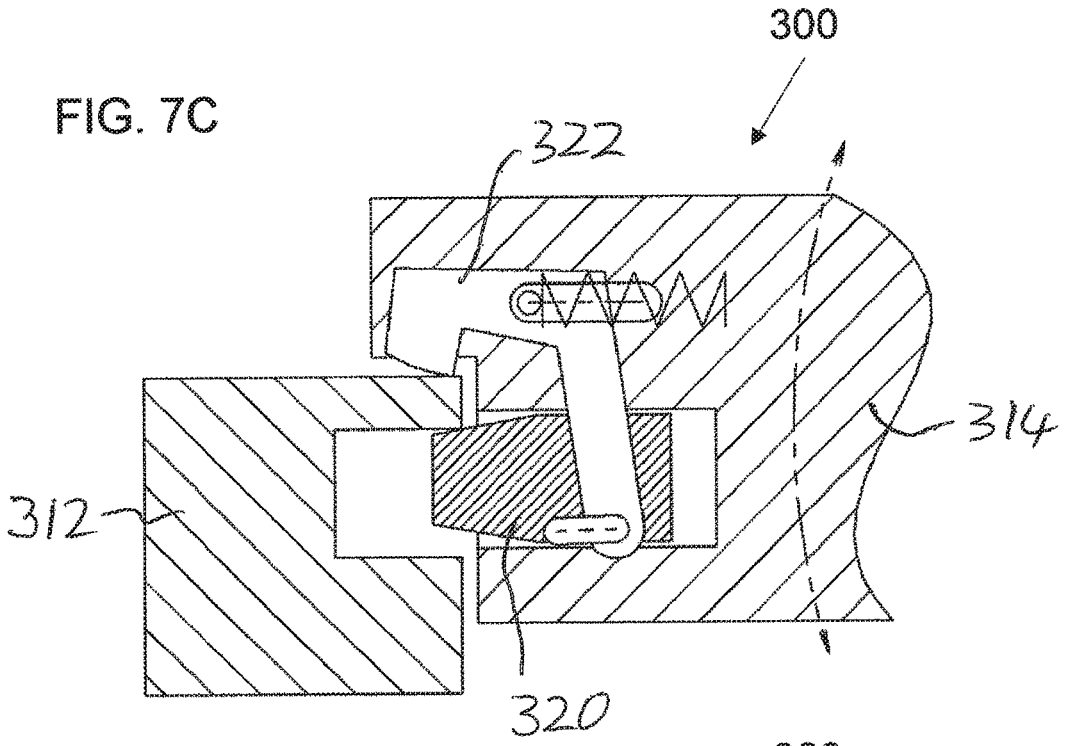
Figure 7D:
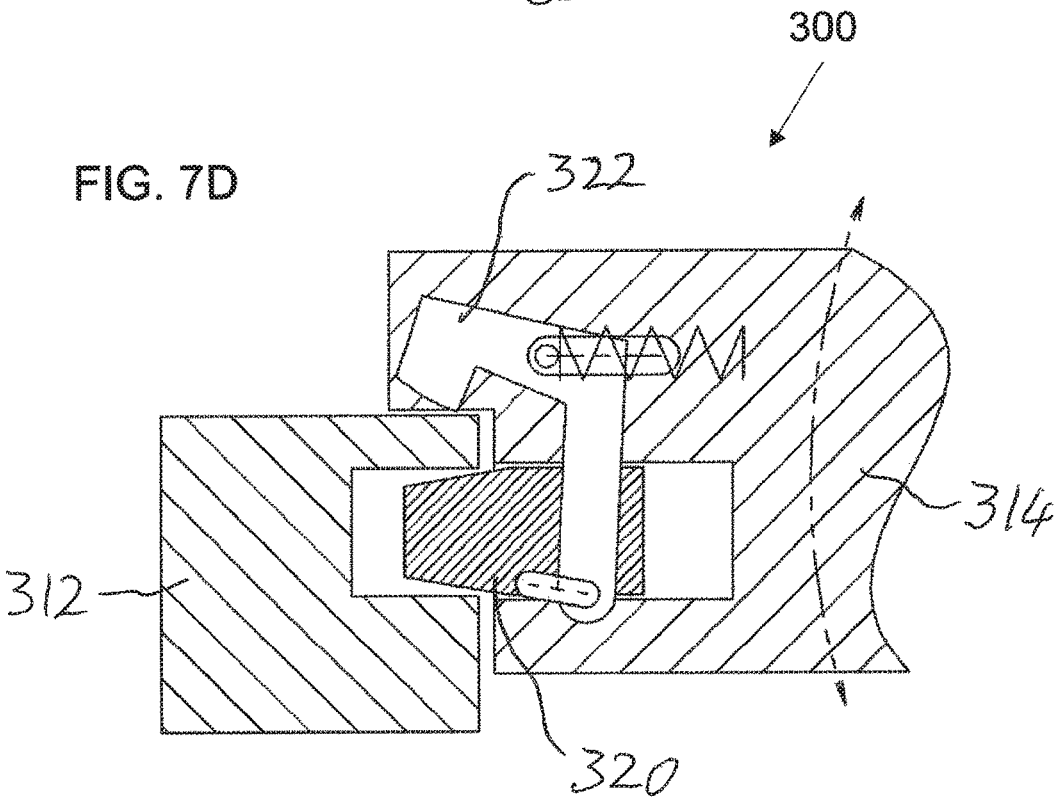

Turning now briefly to apparatus 200 (FIGS. 5 and 6A-6E), this contrasts with apparatus 10 primarily in that it shows an implementation for a sliding panel 214 slidingly mounted relative to the frame rather than a hinge-mounted panel. FIG. 6A illustrates an unlocked state, while FIG. 6B illustrates locking element 220 passing the critical position of locking against panel abutment surface 226 and FIG. 6C shows a fully closed and locked state of apparatus 200. FIGS. 6D and 6E illustrate the displacement of locking element 220 during closing of panel 214 where locking element 220 assumes a resting position corresponding to its locked position. Other than adaptations required to accommodate the linear sliding motion of the panel, the structure and function of apparatus 200 is fully analogous to that of apparatus 10 above. As mentioned earlier, the above description is to be considered a direct description of apparatus 200, with 200 added to the reference numerals, except where it is explicit or self-evident that the description applies exclusively to other embodiments.

Turning now to FIGS. 7A-7D, although the present invention is believed to be particularly advantageous when implemented using a pivotally mounted locking element as in the above embodiments, it should be noted that the same principles may be used to advantage with a wide range of other locking configurations including, but not limited to, arrangements with a locking element 320 which moves through a linear displacement between the released state and the locked state, such as a conventional bolt locking element. An example of such an implementation is shown in FIGS. 7A-7D as apparatus 300. The description of the invention remains as described generically above, with linkage 322 deployed so as to be displaced by a terminal part of a closing motion of panel 314 against strike jamb 312 from the open position (FIG. 7A) through the sequence of FIGS. 7B and 7C to the closed position of FIG. 7D. Linkage 322 is preferably configured such that completion of the closing motion of panel 314 can only occur when locking element 320 assumes its locked state. Most preferably, linkage 322 is deployed such that force applied to displace panel 314 through the terminal part of the closing motion results in a force applied to locking element 320 to displace it towards its locked state.

In order to accommodate the pivotal-to-linear motion conversion between the pivotal motion of linkage 322 and the linear motion of locking element 320, a pin-in-slot or extra connecting linkage 338 may be provided.

Although preferred implementations of the invention maintain rigid mounting of linkage 322 about pivot axis 334 that is fixed in relation to panel 314 (or in a strike jamb-mounted embodiment, in fixed relation to the strike jamb) during closing of the panel, certain embodiments may provide an option of displacing pivot axis 334, for example in a slot 340 against a spring 342, to facilitate disengagement of locking element 320 during unlocking of the apparatus. This displacement is most preferably locked by a releasable retainer except during operation of an unlocking mechanism.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. An apparatus comprising:

(a) an opening bounded by a frame including a strike jamb;

(b) a panel mounted relative to said opening so as to be displaceable between an open position in which said panel is separated from said strike jamb to leave at least part of said opening open and a closed position in which said panel closes against said strike jamb;

(c) a locking element associated with said strike jamb or said panel, said locking element being displaceable between a locked state in which said locking element engages between said panel and said strike jamb in a closed position of said panel to prevent separation of said panel from said strike jamb and a released state in which said panel can be separated from said strike jamb; and (d) a linkage associated with said locking element and deployed so as to be displaced by a terminal part of a closing motion of said panel against said strike jamb from said open position to said closed position, said linkage being deployed so that displacement of said panel through said terminal part of said closing motion applies an input force to said linkage, said linkage being configured to direct at least part of said input force to generate an output force applied to said locking element, said output force acting to displace said locking element towards said locked state.

2. The apparatus of claim 1, wherein said input force is applied to said linkage in a first direction, and wherein said output force is applied to said locking element in a second direction, non-parallel to said first direction.

3. The apparatus of claim 1, wherein said linkage is configured such that a first displacement of said panel within said terminal part of said closing motion results in a second displacement of at least part of said locking element towards said locked state, said second displacement being larger than said first displacement.

4. The apparatus of claim 1, wherein said linkage comprises at least one pivotally-mounted link.

5. The apparatus of claim 4, wherein said linkage further comprises a panel-abutment region deployed to be acted upon by said panel and a locking element actuating region deployed to act on said locking element, wherein said locking element actuating region is located further from said axis than panel-abutment region.

6. The apparatus of claim 4, wherein said pivotally-mounted link is mounted on a spring-loaded pivot axis.

7. The apparatus of claim 1, wherein displacement of said locking element between said released state and said locked state is a pivotal displacement about a locking element rotation axis.

8. The apparatus of claim 7, wherein said output force is applied to said locking element at a bearing surface, and wherein said locking element has a panel engaging surface for engaging said panel, a distance from said bearing surface to said rotation axis being smaller than a distance from said panel-engaging surface to said rotation axis.

9. The apparatus of claim 7, wherein said linkage comprises a pivotally-mounted lever arm pivotally mounted about a linkage pivot axis that is parallel to, but spaced apart from, said locking element rotation axis.

10. The apparatus of claim 1, wherein displacement of said locking element between said released state and said locked state is a linear displacement.

11. The apparatus of claim 1, wherein said locking element and said linkage are integrated with said strike jamb.

12. The apparatus of claim 1, wherein said locking element and said linkage are integrated with said panel.

13. The apparatus of claim 1, wherein said panel is hingedly mounted relative to said frame.

14. The apparatus of claim 1, wherein said panel is slidingly mounted relative to said frame.

15. An apparatus comprising:

(a) an opening bounded by a frame including a strike jamb;

(b) a panel mounted relative to said opening so as to be displaceable between an open position in which said panel is separated from said strike jamb to leave at least part of said opening open and a closed position in which said panel closes against said strike jamb;

(c) a locking element associated with said strike jamb or said panel, said locking element being displaceable between a locked state in which said locking element engages between said panel and said strike jamb in a closed position of said panel to prevent separation of said panel from said strike jamb and a released state in which said panel can be separated from said strike jamb; and (d) a linkage having a locking-element actuating region deployed to act on said locking element and a panel-abutment region deployed so as to be displaced by a terminal part of a closing motion of said panel against said strike jamb from said open position to said closed position, said linkage being configured such that displacement of said panel through said terminal part of said closing motion displaces said panel-abutment region through a first displacement, and wherein said first displacement of said panel-abutment region results in a second displacement of said locking-element actuating region acting on said locking element, thereby displacing said locking element towards said locked state.

16. The apparatus of claim 15, wherein said first displacement occurs in a first direction, and wherein said second displacement occurs in a second direction, non-parallel to said first direction.

17. The apparatus of claim 15, wherein said second displacement is larger than said first displacement.

18. The apparatus of claim 15, wherein said linkage comprises at least one pivotally-mounted link pivotable about a pivot axis.

19. The apparatus of claim 18, wherein a distance from said locking element actuating region to said pivot axis is greater than a distance from said panel-abutment region to said pivot axis.

20. The apparatus of claim 18, wherein said pivotally-mounted link is mounted on a spring-loaded pivot axis.

21. The apparatus of claim 15, wherein displacement of said locking element between said released state and said locked state is a pivotal displacement about a rotation axis.

22. The apparatus of claim 21, wherein said locking-element actuating region acts on a bearing surface of said locking element, and wherein said locking element has a panel engaging surface for engaging said panel, a distance from said bearing surface to said rotation axis being smaller than a distance from said panel-engaging surface to said rotation axis.

23. The apparatus of claim 21, wherein said linkage comprises a pivotally-mounted lever arm pivotally mounted about a linkage pivot axis that is parallel to, but spaced apart from, said rotation axis of said locking element.

24. The apparatus of claim 15, wherein displacement of said locking element between said released state and said locked state is a linear displacement.

25. The apparatus of claim 15, wherein said locking element and said linkage are integrated with said strike jamb.

26. The apparatus of claim 15, wherein said locking element and said linkage are integrated with said panel.

27. The apparatus of claim 15, wherein said panel is hingedly mounted relative to said frame.

28. The apparatus of claim 15, wherein said panel is slidingly mounted relative to said frame.

29. An apparatus comprising:

(a) an opening bounded by a frame including a strike jamb;

(b) a panel mounted relative to said opening so as to be displaceable between an open position in which said panel is separated from said strike jamb to leave at least part of said opening open and a closed position in which said panel closes against said strike jamb; and (c) a lock mechanism associated with said strike jamb or said panel, said lock mechanism comprising a locking element displaceable between a locked state to prevent separation of said panel from said strike jamb and a released state in which said panel can be separated from said strike jamb, wherein said lock mechanism provides a panel abutment region deployed so as to be displaced by a terminal part of a closing motion of said panel against said strike jamb from said open position to said closed position, said panel abutment region being mechanically associated with said locking element so that displacement of said panel abutment region by the terminal part of the closing motion of said panel displaces said locking element towards said locked state, and wherein, when displaced towards said locked state, said locking element passes a critical point of engagement between said panel and said strike jamb such that an opening force applied to said panel results in geometrical or frictional locking between said panel and said locking element opposing displacement of said locking element towards said unlocked state.

30. The apparatus of claim 29, wherein said mechanism is configured such that completion of said closing motion of said panel can only occur when said locking element assumes said locked state.

* * * * *